US005819323A

United States Patent [19]

Edenfield

[11] Patent Number: 5,819,323

[45] Date of Patent: Oct. 13, 1998

[54] SPORTS BRIEF FOR USE WITH A PROTECTIVE CUP

[76] Inventor: Lisa A. Edenfield, 2893 48th Way East, Bradenton, Fla. 34203

[21] Appl. No.: 963,251

[22] Filed: Nov. 3, 1997

[51] Int. Cl.[6] ..... A41D 13/00

[52] U.S. Cl. ..... 2/466; 2/403

[58] Field of Search ..... 2/400, 401, 403, 2/227, 228, 238, 78.1, 455, 466; 602/69–72

[56] References Cited

U.S. PATENT DOCUMENTS

| | | | |
|---|---|---|---|
| 4,014,044 | 3/1977 | Figueroa et al. | 2/404 |
| 4,035,844 | 7/1977 | Atack et al. | 2/404 X |
| 4,660,554 | 4/1987 | Wright | 128/158 |
| 4,811,427 | 3/1989 | Regan | 2/227 |
| 4,967,768 | 11/1990 | Tatro | 128/891 |
| 4,989,594 | 2/1991 | Doherty et al. | 2/247 X |
| 5,134,726 | 8/1992 | Ross | 2/227 X |
| 5,274,854 | 1/1994 | Wenner | 2/403 |

*Primary Examiner*—Gloria M. Hale
*Attorney, Agent, or Firm*—Dorothy S. Morse

[57] ABSTRACT

A sports brief, and a method for its construction, made from a cotton blend material having sufficient compression to satisfy sport league compression requirements, such as but not limited to a 90% cotton and 10% Spandex (LYCRA™) blend. The present invention also comprises a two-panel, semi-detached pouch attached to the inside front surface of the brief for holding a protective cup in the correct position in front of the pelvic region of male athletes to protect male genitals from adverse impact. The semi-detached connection of the pouch to the brief allows the cup to substantially fill the pouch for more secure containment of the cup within the pouch. It is also contemplated for darts to be optionally added to the panels and the front portion of the brief to conform the shape of the pouch and the brief to the cup. The semi-detached connection of the pouch to the brief also allows the cup and pouch combination a limited range of movement when in its protective position so that when impacted the cup does not tend to be forced from the pouch, and further allows the present invention to be more cost effectively manufactured than prior sports briefs having protective cups. Although not critical, it is also contemplated for the pouch to be closed with stretchable hook-and-pile fasteners and for the sports brief to comprise threads having anti-microbial properties. Applications may include, but are not limited to, garments used by male athletes to play baseball, softball, hockey, and football.

19 Claims, 2 Drawing Sheets

SPORTS BRIEF FOR USE WITH A PROTECTIVE CUP

BACKGROUND

1. Field of Invention

This invention relates to garments used to protect the front pelvic region of male athletes from adverse sports impact, specifically to a sports brief, and a method for its construction, made from a cotton blend material having sufficient compression to satisfy sports league compression requirements, which typically require a 90% cotton and 10% Spandex/LYCRA™ blend or similar mix, which also comprises a semi-detached, two-panel pouch attached to the inside surface of the front of the garment for holding a protective cup in the correct position in front of the pelvic region of male athletes to protect male genitals from adverse sports impact, the semi-detached connection of the pouch to the brief allowing the cup to substantially fill the pouch for more secure containment of the cup within the pouch and also allowing the cup and pouch combination a limited range of movement when in its proper protective position so that when impact occurs the cup does not tend to be forced from the pouch, the semi-detached two-panel construction without a front fly opening also allowing the present invention to be more cost effectively manufactured than prior art sports briefs having protective cups. Applications may include, but are not limited to, garments used by male athletes to play baseball, softball, hockey, and football.

2. Description of Prior Art

It is the requirement of many sports leagues that male players wear protective gear to protect the front pelvic region from adverse impact. League requirements generally include provisions that the protective gear be made from a compressive fabric and that the protective gear comprises means for retaining a rigid protective cup in a proper position to protect male athlete genitals. However, many small boys, particularly those playing sports for the first time, find the available protective gear to be oversized and uncomfortable. As a result parents find that the boys resist wearing it. Also, many protective garments on the market are not properly sized for small boys and therefore do not effectively provide the necessary protection for them. Further, prior art protective garments are inconvenient to use since they are not sufficiently comfortable for small boys to wear during non-sports activities. As a result, small boys must take the time to dress twice for an after-school game, once in the morning with conventional underwear to be comfortable at school, then again prior to the game they will replace the non-protective underwear with a protective garment suitable for sports league use. The present invention overcomes the above disadvantages by providing a sports garment that is comfortable to wear from school to the ballfield. It is sized according to common garment industry dimensions used to construct conventional underwear so that an appropriately sized protective garment can easily be selected for each athlete. The present invention has a pouch configured to securely hold in place a protective cup properly sized to the dimension of the attached brief Each pouch is also configured so that the size of protective cup needed substantially fills the pouch for maximum protection of the male athlete wearing the attached brief The present invention further has a two-panel, semi-detached pouch that is configured with a least one dart to be non-binding during use and to hold the protective cup in a proper protective position under a wide range of athletic movement. In addition, the present invention has a pouch with an upper opening having an easily opened fastener so that a protective cup can be rapidly inserted and removed therefrom allowing the athlete to quickly convert the garment into protective sports gear immediately prior to sports use.

Protective sports garments are known. Although traditional jockstraps are made from stretchable materials to provide a wide range of athletic motion and have pouch-shaped crotch panels that are non-binding, many male athletes, particularly small boys, find them uncomfortable to wear. In contrast, the present invention offers a brief-type style of protective garment that most athletes find comfortable to wear. Even jockstraps having wide waistbands that provide additional support are not as comfortable as the brief-style of construction of the present invention. The two-panel pouch of the present invention for holding a rigid protective cup in front of the lower pelvic region of a male athlete is designed and contoured so that the cup substantially fills the pouch. The two-panel construction with a longer front panel attached to the brief on three, provides enhanced support for the pouch allowing it to remain in its protective position, with the attachment, including lateral stitching of the upper rectangular shaped portion of the front panel to the front portion of the brief between the leg openings and the waistband as well as top attachment to the front portion of the brief along the bottom edge of the waistband, provides enhanced support for the pouch allowing it to better remain in its protective position. The lower triangular shaped portion of the front panel is also semi-detached from the front inside surface of the brief to provide a limited range of motion of the lower triangular shaped portion of the pouch during sports impact for optimum protective benefit to the athlete. The stitching which attaches the front panel to the brief waistband, as well as between the waistband and the leg openings, in addition to the force of gravity and the friction of the front pouch panel moving against the material of the front portion of the brief, all work in combination to maintain the rigid cup in its proper protective position with the pouch formed by the front and back panels during sports activity. In contrast, as in some prior art garments when a single panel is attached to the front of a brief on three of its sides to form a pocket, the pocket will remain stationary under all athletic motion as a result of its construction. Therefore, during some sports activity, such as when a baseball player slides into a base, the stationary pocket tends to encourage forces exerted on the protective cup to force the cup out of the pocket, particularly when the protective cup substantially fills the pocket. If a protective cup were used which did not substantially fill such a single panel stationary pocket, it could become displaced within the pocket and might not provide the needed protection to the athlete.

The prior art thought to be most closely related to the present invention are the inventions disclosed in U.S. Pat. No. 5,274,854 to Wenner (1994), U.S. Pat. No. 4,660,554 to Wright (1987), and U.S. Pat. No. 4,967,768 to Tatro (1990). The Wenner invention comprises an athletic support short made of resilient material which has a pouch extending between its waistband and the bottom of its crotch to hold a protective cup. The Wenner invention is contemplated for use as either an exterior garment or an under garment and its pouch is secured to the short at its top and bottom. The sides of the Wenner pouch remain unattached to the short whereby a portion of the pouch between its top and bottom is movable relative to the short. The present invention has a comfort advantage over the Wenner invention by providing a semi-detached pouch which conforms more closely in shape to the protective cup used and has a back panel that is only secured to the lower inside front portion of its attached brief to form a pouch which is substantially filled by a protective cup inserted therein.

The Wright invention provides an athletic brief manufactured from 13% Spandex/LYCRA™ and 87% Nylon, and having a cup pocket sewn along its sides and bottom to the front of its brief. The present invention offers an advantage over the Wright invention in having a cup pouch better conforming to the shape of the protective cup to hold the cup more securely in place during use. Also, the present invention has a comfort advantage over the Wright invention by providing a semi-detached pouch having a back panel that is only secured to the lower inside front portion of its attached brief, offering a limited range of motion for the pouch during athletic use. Further, the present invention offers a cotton-stretchable fabric mixture, instead of the nylon composition of the Wright invention which can be too hot for an athlete to wear during warm weather.

The Tatro invention comprises a protective cup supporter and cup combination made from cotton material which does not compress or restrain the wearer's body. The fabric is also lightweight to minimize body heat build up and sweating. The sides and bottom of the single-panel Tatro cup pocket are sewn to the front of the supporter. The present invention has a comfort advantage over the Tatro invention by providing a two-panel, semi-detached pouch which conforms more closely in shape to the protective cup used and has a back panel that is only secured to the lower inside front portion of its attached brief In addition, the present invention offers the compression material typically required by sports leagues for protective garments. It is not known to have a sports brief made from a cotton blend material having sufficient compression to satisfy sport league compression requirements, such as but not limited to a 90% cotton and 10% Spandex (LYCRA™) blend, which also comprises a two-panel semi-detached pouch attached to the inside front portion of the garment for holding a protective cup in the correct position in front of the front pelvic region of male athletes to protect male genitals from adverse sports impact, the two-panel construction and semi-detached connection of the pouch to the brief allowing the cup to substantially fill the pouch for more secure retention of the cup within the pouch, while at the same time allowing the cup and pouch combination a limited range of movement when in place so that when impacted the cup does not tend to be forced from the pouch, the two-panel semi-detached pouch construction and absence of front fly closure also allowing the present invention to be more easily manufactured in large quantities and to be more cost effectively manufactured than prior sports briefs having protective cups.

SUMMARY OF INVENTION—OBJECTS AND ADVANTAGES

It is the primary object of this invention to provide a sports brief for small boys that is able to effectively hold in place a rigid protective cup designed for protecting their genitals against adverse sports impact. It is also an object of this invention to provide a sports brief that is more comfortable than currently available protective gear so that small boys playing league sports such as baseball will not resist wearing it. A further object of this invention is to provide a sports brief that is designed for comfortable wear by male athletes of all ages and stature. Another objective of this invention to provide a sports brief that uses a compression material required by sports leagues to hold protective cups. It is also an object of this invention to provide a sports brief with a protective pouch having sufficient resiliency, dimension, and configuration so that the protective cup inserted therein substantially fills the pouch and tends to remain in a proper position during adverse impact for optimum athlete protection. A further object of this invention is to provide a sports brief that is designed for cost effective manufacture. It is also an object of this invention to provide a sports brief with an effective pouch closure that is comfortable and safe for the athlete. A further object of this invention is to provide a sports brief that is dimensioned according to conventional underwear sizes to make it easier to select the proper size of protective garment for the athlete. It is also an object of this invention to provide a sports brief that can be comfortably worn during non-sports activity and easily converted into a protective garment before a game by rapid insertion of a protective cup into a convenient, easily accessed opening in the top of a pouch which is attached to the front inside surface of the brief It is a further object of this invention to provide a sports brief that is made from material comprising threads having anti-microbial properties.

As described herein, properly manufactured and worn with a rigid protective cup properly inserted therein, the present invention would provide a sports brief for protecting the genitals of a male athlete from adverse sports impact. The brief would have a semi-detached pouch attached to the lower portion of the front inside surface of the brief for enhanced comfort of the wearer. Although the present invention would be dimensioned according to standard sizes used by the garment industry for making underwear, and thereby would be particularly comfortable and well-suited for small boys, it is contemplated for the present invention to be used by male athletes of all ages and stature. It is also contemplated for the present invention to be made from compression fabric, such as a 90% cotton and 10% Spandex (LYCRA™) blend, to meet compression requirements established by sports leagues for garments designed to protect the lower front pelvic region of male athletes. The present invention provides a semi-detached pouch for holding a rigid protective cup, the pouch being designed to conform to the shape of the cup so that the cup substantially fills the pouch when inserted. Although not critical, it is contemplated for at least one dart to be used to better conform the shape the back panel of the pouch to the configuration of the protective cup selected for use. It is also contemplated for the pouch to have an easily accessed upper opening so that the brief can be comfortably worn during non-sports activity, and when needed for use as a sports garment a protective cup can be rapidly inserted into the upper opening for fast and easy conversion of the brief into a protective sports garment. The semi-detached design of the pouch which optimizes the use of gravity, as well as the friction of the material comprising the front inside portion of the brief against the material comprising the front panel of the pouch, to hold the pouch in a proper protective position during use, also provides a limited range of movement so that when the cup is impacted it does not tend to become forced from the pouch. The closing means for the top of the pouch must be sufficiently secure to retain the cup in the pouch during impact, be comfortable to the wearer, and allow for rapid insertion and removal of a protective cup. Although not critical, it is contemplated for one or more stretchable hook-and-pile fasteners to be used to retain a protective cup within the pouch. Manufacture of the present invention is cost effective, since the pouch is made from two panels and it can be independently assembled from the brief to which it will be attached, the pouch is only partially attached to the interior front portion of the brief, the present invention is made in standard industry under garment sizes, and the brief of the present invention is made without a front fly opening. Also, it is contemplated for the brief to be made from material comprising threads having anti-microbial properties to minimize to growth of bacterial and other organisms on the warm, moist skin of active perspiring athletes.

The description herein provides preferred embodiments of the present invention but should not be construed as limiting the scope of the sports brief invention. For example, variations in the configuration of the protective cup used, the amount and type of stitching used to attach the two-panel pouch to the inside front portion of the brief, the type and number of fasteners used, the widths of the seams used to assemble the garment, and the length and number of darts used in the back pouch panel and the bottom front portion of the brief to better conform the material to the depth dimension of the protective cup intended for use, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
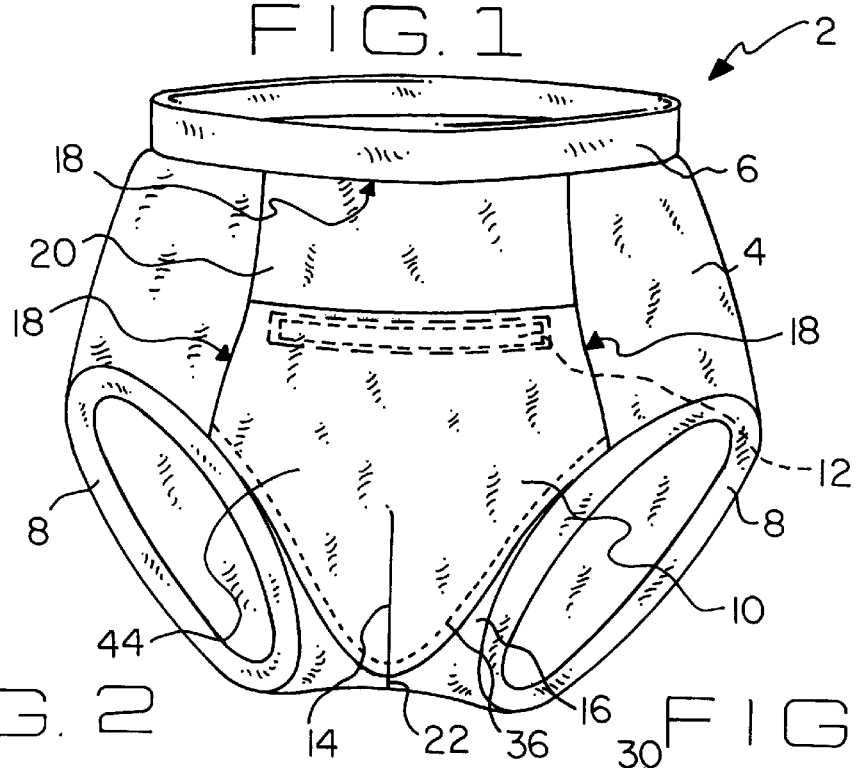
FIG. 1 is a perspective view a first embodiment of the present invention turned inside-out and showing the inside front portion of the sports brief of the invention having a two-panel cup-holding pouch attached thereto.

FIG. 1 shows a preferred embodiment of the present invention having a protective sports brief 2 turned inside-out to reveal a two-panel pouch 44 attached to its inside front surface. FIG. 1 shows sports brief 2 comprising a quantity of material 4 bounded on its upper edge by a waistband 6 and constructed so that two spaced apart leg openings 8 are formed laterally in the lower portion of sports brief 2 and opposite to waistband 6. A vertically oriented dart 22 is shown in material 4 in the front lower portion of sports brief 2 and centrally positioned between leg openings 8 to help material 4 better conform to the shape of pouch 44. FIG. 1 further shows pouch 44 having a larger front panel 20 and a smaller back panel 10 with back panel 10 having a vertical dart 14 extending between its lower edge and its center portion. Although not critical, vertical dart 14 allows back panel 10 to conform better to the shape of a protective cup, shown as number 24 in FIGS. 2–5, once protective cup 24 is fully inserted into pouch 44 so that back panel 10 is not taut across the back concave surface of protective cup 24. Although not shown, it is within the contemplation of the present invention to have other embodiments with back panels 10 having more than one dart 14, material 4 having more than one dart 22, and wherein front panel 20 also has at least one vertical dart 14 extending from its lower edge toward its central portion FIG. 1 also shows the sides 36 of back panel 10 positioned between back panel 10 and front panel 20. Front panel 20 is attached at its upper edge, shown in FIG. 6 as number 32, to sports brief 2 adjacent to waistband 6 with stitching 18, and upper sides of front panel 20, shown in FIG. 6 as number 34, are both attached to sports brief 2 with additional stitching 18 between waistband 2 and leg openings 8. In contrast, FIG. 1 shows back panel 10 attached at its folded upper edge, shown in FIG. 7 as number 40, to the central portion of front panel 20 by fastening means 12, fastening means 12 being positioned between back panel 10 and front panel 20 as well as, the upper sides of back panel 10, shown in FIG. 7 as number 34, both being attached to sports brief 2 adjacent to leg openings 8 with stitching 18. Although not critical, it is contemplated for fastening means 12 to comprise at least one hook-and-pile type of fastener. In the alternative, snaps or other easily opened but secure fasteners could be used. In a preferred embodiment fastening means 12 comprises a stretchable hook-and-pile type of fastener of sufficient length and width to securely retain a protective cup within pouch 44 during adverse sports impact, such as what might be incurred when a baseball player slides into a base. It is contemplated for the present invention to be made from materials providing sufficient compression to meet sport league protective gear compression requirements. Although it is not contemplated for the present invention to be restricted to the following, one preferred embodiment of the present invention comprises a compression material blend made from 90% cotton and 10% Spandex (LYCRA ™). It is also contemplated for the present invention to be made from materials comprising threads having anti-microbial properties.

Although FIGS. 2–5 show two preferred embodiments of a protective cup 24 contemplated for use in pouch 44, it is within the scope of the present invention for pouch 44 to be configured for securely holding protective cups of other similar dimensions. Both embodiments of protective cup 24 are currently marketed and have a rigid center portion 26, a ring 28 of resilient material attached completely around the perimeter of center portion 26 to cushion the perimeter, and a plurality of spaced-apart ventilation holes 30 through center portion 26. Ring 28 may be stretched securely around the perimeter of center portion 26, or adhesives may be used to enhance attachment of ring 28 to front and back surfaces of center portion 26. It is contemplated for any seam in ring 28 to be on the upper perimeter of ring 28. The number of ventilation holes 30 in center portion 26 is not critical, but should be sufficient to prevent heat build-up in and around the part of the athlete's body positioned under center portion 26. Although the resilient material used to make ring 28 should have a non-slip surface texture, its texture should not prevent protective cup 24 from being easily inserted and removed from pouch 44.

Figure 2:
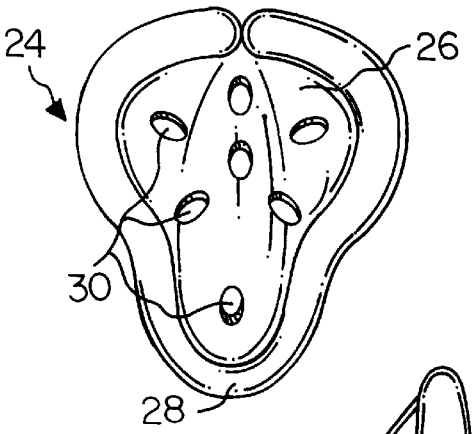
FIG. 2 is a front view of a first embodiment of a protective cup contemplated for use with the sports brief of the invention showing its upper half having a greater width dimension than its lower half.
Figure 4:
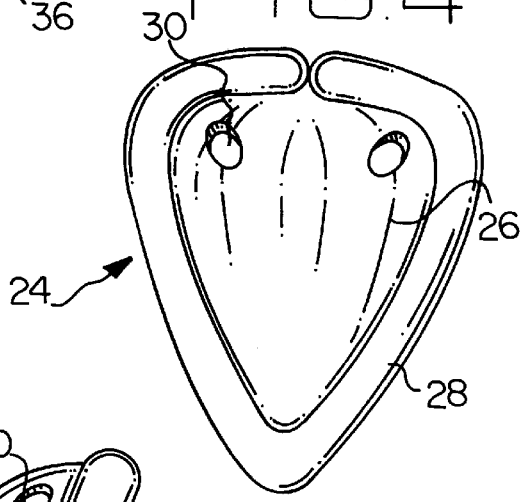
FIG. 4 is a front view of a second embodiment of a protective cup contemplated for use with the sports brief of the invention showing its upper half having a greater width dimension than its lower half.
Figure 3:
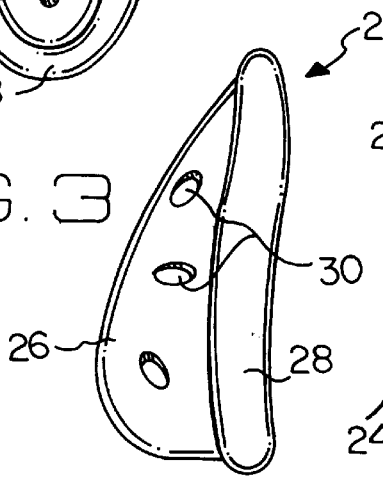
FIG. 3 is a side view of the first embodiment of a protective cup contemplated for use with the sports brief of the invention showing its lower half having a greater depth dimension than its upper half.
Figure 5:
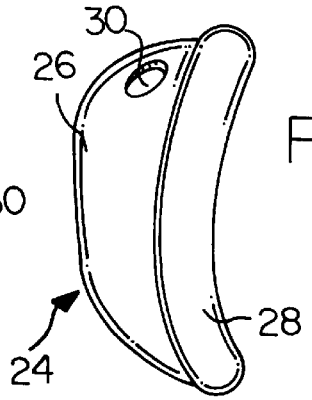
FIG. 5 is a side view of the second embodiment of a protective cup contemplated for use with the sports brief of the invention showing its upper half having a greater depth dimension than its lower half.

FIG. 2 shows the first embodiment of protective cup 24 to be used with the present invention having a symmetrical configuration and an upper portion with a width dimension greater than the width dimension of its lower portion. In profile, FIG. 3 shows the lower portion of the first embodiment of protective cup 24 having a greater depth dimension than the depth dimension of its upper portion. FIG. 4 shows the second embodiment of protective cup 24 to be used with the present invention also having a symmetrical configuration and an upper portion with a width dimension greater than the width dimension of its lower portion. However, FIG. 4 shows the second embodiment of protective cup 24 having the sides of its center portion 26 being more uniformly tapered to a bottom point than is shown in FIG. 1 for the first embodiment, resulting in a narrower lower portion and thereby making the second embodiment of protective cup 24 more suitable for use with briefs 2 dimensioned for youths. In profile, FIG. 5 shows the upper portion of protective cup 24 having a greater depth dimension than the depth dimension of its lower portion.

Figure 6:
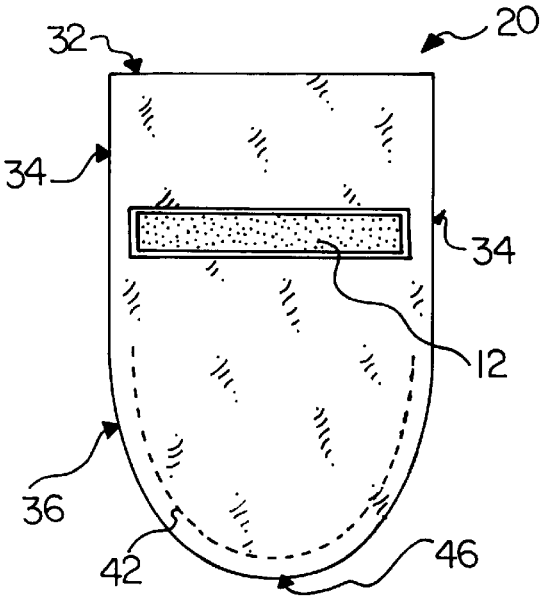
FIG. 6 is a back view of a first preferred embodiment of the front panel of the pouch of the present invention having one part of a hook-and-pile fastener centrally attached thereto and a stitching line near to its lower edge indicating the approximate attachment of the front panel to the back panel to form the lower free-hanging triangular shaped portion of the pouch.
Figure 8:
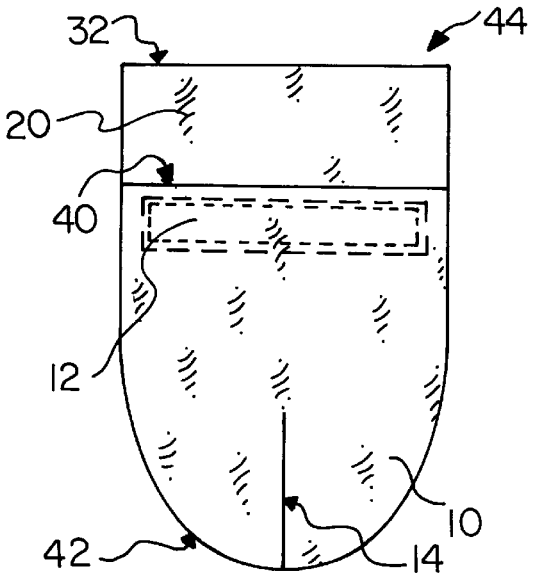
FIG. 8 is a back view of the back panel of the pouch attached to the front panel of the pouch and turned inside-out so that the stitching lines in FIGS. 6 and 7 now define its lower edge, with a dart extending upwardly from its lower edge prior to attachment to the inside front surface of the sports brief.
Figure 7:
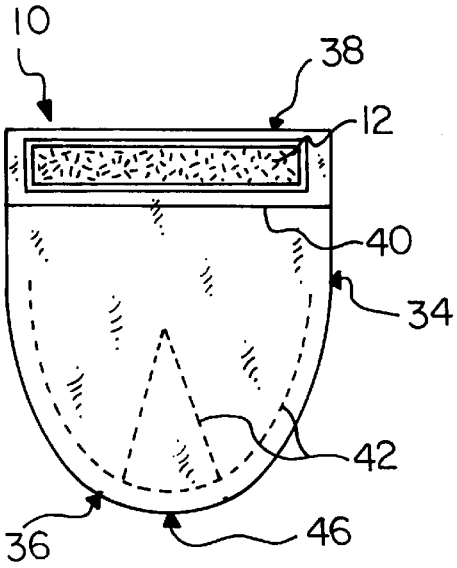
FIG. 7 is a back view of the back panel of the pouch of the present invention having one part of a hook-and-pile fastener attached near to its upper edge, an inverted V-shaped stitching line extending upwardly from its lower edge, and a stitching line near to its lower edge indicating the approximate attachment of the front panel to the back panel to form the lower free-hanging triangular shaped portion of the pouch.

FIGS. 6–8 show the features and construction of a preferred embodiment of two-panel pouch 44. It is contemplated for pouch 44 to be dimensioned during manufacture for use with a particular embodiment and size of protective cup 24 to provide secure containment of protective cup 24 within pouch 44 during use. FIG. 6 shows the upper portion of front panel 20 having an essentially rectangular configuration with an upper edge 32 and side edges 34. FIG. 6 also shows the lower portion of front panel 20 having an essentially triangular configuration, downwardly narrowing sides 36, a bottom point 46, and a stitching line 42 positioned at a uniformly spaced distance from sides 36. FIG. 6 further shows fastening means 12 centrally attached to front panel 20 within its rectangular upper portion, approximately two-thirds of the distance downward from upper edge 32. Although not critical to the present invention, in the preferred embodiment it is contemplated for front panel 20 to be made from the same material blend that is used to manufacture brief 2.

FIG. 7 shows the upper portion of back panel 10 also having an essentially rectangular configuration with an upper edge 38 and side edges 34. FIG. 7 further shows the lower portion of back panel 10 having an essentially triangular configuration, downwardly narrowing sides 36, a bottom point 46, and a stitching line 42 positioned at a uniformly spaced distance from sides 36. FIG. 7 also shows back panel 10 having a fold line 40 at a spaced distance from upper edge 38 for turning upper edge 38 toward the inside of pouch 44 when back panel 10 is connected to front panel 20, to prevent the unfinished upper edge 38 from becoming unraveled during use. In addition, FIG. 7 shows fastening means 12 centrally attached to back panel 10 between side edges 34 and positioned between fold line 40 and upper edge 38. Fastening means 12 must be easy opening for rapid insertion and removal of protective cup 24 from pouch 44, but at the same time fastening means 12 must also be able to securely retain protective cup 24 within pouch 44 during sports impact. Although not critical, in the preferred embodiment it is contemplated for fastening means 12 to comprise a stretchable hook-and-pile type of fastener. FIG. 7 a further shows an inverted V-shaped stitching line 42 for forming a dart such as dart 14 shown in FIG. 8 in the lower portion of back panel 10 to form a back panel 10 that more effectively holds protective cup 24 in place during use. Although not critical to the present invention dart 14 allows back panel 10 to have a contoured shape to prevent back panel 10 from being too taut against the concave back surface of protective cup 24 and thereby enhance the comfort provided by pouch 44 to male athletes (not shown). Although in the preferred embodiment shown in FIG. 7, only one inverted V-shaped stitching line 42 is identified in back panel 10, it is within the contemplation of the present invention to have more than one inverted V-shaped stitching line 42 in back panel 10, as well as one or more inverted V-shaped stitching lines 42 in front panel 20. Although not critical to the present invention, in the preferred embodiment it is contemplated for back panel 10 to be made from the same material blend that is used to manufacture brief 2.

FIG. 8 shows back panel 10 positioned against front panel 20 and attached to front panel 20 at stitching line 42. In FIG. 8, pouch 44 has been turned inside-out after stitching and as a result stitching line 42 is shown defining the bottom edge of pouch 44. FIG. 8 also shows dart 14 extending centrally upward from the bottom of back panel 10, formed from stitching together the sides of inverted V-shaped stitching line 42 shown in FIG. 7. Although not shown, sides 36 are positioned between back panel 10 and front panel 20. FIG. 8 also shows the top portion of back panel 10 folded toward front panel 20 so that fold line 40 defines the top edge of back panel 10. Further, fastening means 12 is shown in FIG. 8 positioned between back panel 10 and front panel 20. In FIG. 8, side edges 34 of both back panel 10 and front panel 20 remain unfinished, unattached to one another, and ready for attachment to sports brief 2 between waistband 6 and leg openings 8. The larger upper portion of front panel 20, when attached on three sides to the front portion of brief 2, provides enhanced support for pouch 44 to better maintain pouch 44 in its optimum protective position during use.

Figure 9:
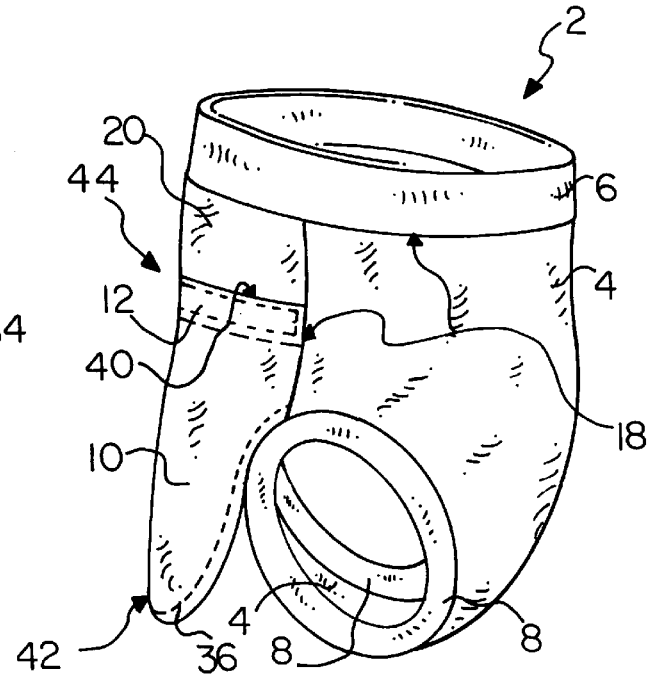
FIG. 9 is a side view of the present invention turned inside-out with the lower portion of its pouch remaining unattached to its sports brief.

FIG. 9 shows sports brief 2 turned inside-out to reveal waistband 6 attached to material 4 by stitching 18, and the sides of both front panel 20 and back panel 10 of pouch 44 also attached to material 4 between waistband 6 and leg openings 8 by stitching 18. The upper edge of front panel 20 is also connected to waistband 6 by stitching 18. In addition, FIG. 9 shows the upper edge of back panel 10 defined by fold line 40 and the lower edge of pouch 44 defined by stitching line 42, with sides 36 positioned between back panel 10 and front panel 20. A portion of the opposed leg opening 8 of sport brief 2 is visible through its adjacent leg opening 8. FIG. 9 also shows fastening means 12 securing the upper edge of back panel 10 to the central portion of front panel 20. In FIG. 9 the lower portion of pouch 44 is shown to be free-hanging with back panel positioned for placement against the lower abdomen and genitals of a male athlete (not shown) during use.

In a preferred embodiment of the present invention sized to the approximate dimensions of a size 14 undergarment, it is contemplated for brief 2 to comprise a waistband 6 having an unstretched circumference of approximately seventeen and one-half inches, leg openings 8 to each have a circumference of approximately fifteen inches, brief 2 to have a crotch seam (not shown) between leg openings 8 with a width dimension of approximately four inches, one dart 22 having a length dimension of approximately three inches and extending from the crotch seam centrally upward into the front portion (not shown) of brief 2, the front portion of brief 2 having an unstretched width dimension of approximately five and one-fourth inches, a waistband 6 to leg opening 8 measurement of approximately five and one-half inches, and a measurement from the top of waistband 6 to the crotch seam of approximately eleven inches. In the preferred embodiment it is also contemplated for seams to having stitching 18 which is approximately one-fourth inches in width and for waistband 6 to be made from a non-roll stretchable material having a width dimension of approximately one and three-thirty secondths of an inch. Correspondingly, when the first embodiment of protective cup 24 is to be used with an approximate size 14 embodiment of the present invention, it is contemplated for pouch 44 to have an upper rectangular portion with a length dimension of approximately three and one-fourth inches and a width dimension of approximately five and three-eighths inches, as well as a lower triangular portion narrowing to a bottom point which has a total length dimension of approximately six inches, the detached portion of pouch 44 having a length dimension of approximately four inches. When the second embodiment of protective cup 24 as shown in FIGS. 4+5 is to be used with an approximate size 14 embodiment of the present invention, it is contemplated for the length of the lower portion of pouch 44 to be approximately one-half of an inch longer and approximately one-half of an inch wider than the pouch 44 constructed for the first embodiment of protective cup 24 shown in FIGS. 2 and 3, due to the narrower but more elongated configuration of the lower portion of the second embodiment of protective cup 24 and its slightly increased depth dimension. For use with the above dimensioned approximate size 14 embodiment of the present invention, the first preferred embodiment of protective cup 24 would have a center portion with a length dimension of approximately five inches, a maximum depth dimension of approximately one and three-fourths inches measured approximately one and one-half inches upward from its bottom edge, a maximum width dimension of approximately four and one-half inches measured approximately one and one-half inches downward from its top edge, and a width dimension of approximately two inches measured approximately one and one-half inches upward from its bottom edge. In the first preferred embodiment of protective cup 24 for use with an approximate size 14 embodiment of the present invention, it is contemplated for ring 28 to be approximately one and three-fourths inches in width, with approximately three-fourths of an inch of ring 28 positioned against the front perimeter surface of center portion 26. In contrast, the second preferred embodiment of protective cup 24 contemplated for use with the above dimensioned approximate size 14 embodiment of the present invention would have a center portion with a length dimension of approximately five and one-fourth inches, a maximum depth dimension of approximately two and one-half inches measured approximately two and three-fourths inches down from its top edge, and a maximum width dimension of approximately three and five-eighths of an inch measured approximately two and one-half inches downward from its top edge. In the second preferred embodiment of protective cup 24 for use with an approximate size 14 embodiment of the present invention, ring 28 would have a width dimension of approximately one and three-fourths inches, with approximately three-fourths of an inch of ring 28 being positioned against the front perimeter surface of center portion 26. Although not critical, it is contemplated for the present invention to comprise the use of adhesives to hold at least a portion of ring 28 in place against center portion 26 when necessary.

To construct a preferred embodiment of the present invention, one would cut a quantity of material 4 sufficient to form the back of brief 2 as well as a separate front portion (not shown) for attachment to the back of brief 2 with a crotch seam and two vertically oriented and approximately parallel front seams extending between waistband 6 and leg openings 8. Dart 22 would then be formed with stitching 18 centrally upward from the bottom edge of the front portion of brief 2. The bottom of the front portion of brief 2 would be attached to the lower edge of the back portion of brief 2 with stitching 18 to form the crotch seam (not shown). Independent from the formation of brief 2, pouch 44 would be constructed from the joining together of front panel 20 and back panel 10 as follows. Dart 14 would first be formed with stitching 18 centrally upward from the bottom edge of back panel 10 along inverted V-shaped stitching line 42. One part of a two-part fastener comprising fastening means 12 would be attached centrally to the back surface of the upper rectangular portion of front panel 20, approximately two-thirds of the distance from upper edge 32 to the interface between the upper rectangular portion of front panel 20 and its lower triangular portion. The second part of fastening means 12 would be attached centrally to the back surface of back panel 10, between fold line 40 and upper edge 38. Subsequently, the detached portion of pouch 44 would be formed by attaching the lower portion of back panel 10 to front panel 20 with stitching 18 along stitching line 42, and positioning the front surface of front panel 20 in contact with the back surface of back panel 10. Pouch 44 would then be turned inside-out so that sides 36 are positioned between back panel 10 and front panel 20. Upper edge 38 on back panel 10 would also be folded toward front panel 20 along fold line 40 so that the cooperating parts of fastening means 12 face one another for secure retention of protective cup 24 within pouch 44 during use. Pouch 44 would then be attached to brief 2 by stitching 18 as follows. Both side edges 34 of front panel 20 and back panel 10 would be attached, along with the sides edges of the front portion (not shown) of brief 2, to the back portion of brief 2 between waistband 6 and leg openings 8. Upper edge 32 would be stitched, along with the upper edge of the front panel (not shown) of brief 2 and the upper edge of the back portion of brief 2, to waistband 6. Leg openings 8 would then be bound with additional material 4, or otherwise finished, to provide a smooth edge for athlete comfort. The lack of a front fly opening in brief 2 and the semi-detached construction of pouch 44 allow the present invention to be cost effectively manufactured.

To use the present invention, a male athlete (not shown) would wear brief 2 so that pouch 44 is on the inside of brief 2 and positioned in front of his front pelvic region. Prior to any type of sports activity wherein the male athlete is subject to adverse sports impact to his front pelvic region, the cooperating parts of fastening means 12 would be separated from each other to open pouch 44. Protective cup 24 can be rapidly and easily inserted into pouch 44, since fastening means 12 can be easily opened and since ring 28 is made of a resilient material with an appropriate non-slip surface texture to allow rapid insertion and removal of protective cup 24 from pouch 44. Once protective cup 24 is positioned within pouch 44, the cooperating parts of fastening means 12 would then be connected to one another to securely close protective cup 24 within pouch 44. Since protective cup 24 substantially fills pouch 44, no adjustment of protective cup 24 within pouch 44 for proper positioning is required. Since brief 2 is sized according to garment industry dimensions for underwear, it is easy for the parents of small boys to select a properly fitting protective brief 2 for their athletic sons. This means of sizing and configuration also allows the present invention to be comfortably worn by male athletes of all sizes and stature. Further, the conventional sizing and brief-type of configuration allows the present invention to be comfortably worn during non-sports activity and then rapidly converted into a protective sports garment prior to a game without the athlete having to completely redress. Due to the two-panel construction of pouch 44 and its semi-detached connection to brief 2, a combination of gravity and material friction between front panel 20 and the front portion of brief 2 allows protective cup 24 to be optimally maintained in a proper protective position in front of the front pelvic region of a male athlete (not shown) during a full range of athletic motion. Also, when protective cup 24 is adversely impacted, protective cup 24 does not tend to be forced from pouch 44 due to several factors, including the secure manner in which fastening means 12 attaches back panel 10 to front panel 20, the manner in which dart 14 causes the compression material of pouch 44 to conform to the shape of protective cup 24 and the fact that protective cup 24 substantially fills pouch 44, in addition to the semi-detached connection of pouch 44 to brief 2 which allows for a limited range of movement of the pouch 44 and protective cup 24 combination while in its protective position. The contoured configuration of back panel 10, when placed against the concave portion of protective cup 24, also allows pouch 44 to be non-binding against the male athlete (not shown). Further, the fabric from which the present invention is made, including the preferred blend of approximately 90% cotton and approximately 10% Spandex/LYCRA™ satisfies the compression requirement of sports leagues, and at the same time affords comfort to the male athlete wearing it. Using material 4 comprising threads with anti-microbial properties to form brief 2 and pouch 44 provides an additional benefit for the athlete.

What is claimed is:

1. A protective sports garment configured according to standard sizes used in the garment industry for manufacturing underwear, for use in positioning a rigid protective cup in front of the front pelvic region of a male athlete to protect the genitals of the male athlete from adverse sports impact, said garment comprising a brief made from a compressive material; said brief having an upper edge, a front portion with an inside surface, a waistband attached to said upper edge, and two leg openings laterally spaced apart from one another in positions opposed to said waistband; said garment also comprising a pouch formed from a front panel and a back panel, said front panel and said back panel each having an upper portion which is substantially rectangular and has a length dimension, said front panel and said back panel each also having a lower triangular portion which tapers to a bottom point, a top edge, upper side edges, and lower sides, said length dimension of said rectangular upper portion of said front panel being greater than said length dimension of said rectangular upper portion of said back panel, said length dimension of said rectangular upper portion of said front panel sized to extend substantially from said waistband to said leg openings, said top edges and upper sides of said front panel being connected to said inside surface of said front portion of said brief, said upper sides of said back panel also being connected to said front portion of said brief, said lower sides and bottom point of said front panel and said lower sides and said bottom point of said back panel being connected respectively to one another and remaining separate from said brief so that gravity and material friction help maintain said pouch in its proper protective position but at the same time allowing said pouch to have a limited range of motion to prevent impact thereupon from tending to force from said pouch a protective cup placed therein; said pouch also comprising stitching means to securely connect said lower sides and said bottom points of said front panel to said lower sides and said bottom points of said back panel, as well as said front panel and said back panel to said inside surfaces of said front portion of said brief, and said pouch further comprising fastening means to securely attach said upper portion of said back panel to said front panel during sports use so that when a rigid protective cup is placed between said front panel and said back panel, said fastening means securely retains the protective cup between said front panel and said back panel in a proper position to protect the front pelvic region of a male athlete wearing said garment while engaging in sports activity.

2. The garment of claim 1 wherein the protective cup to be used with said garment has a concave back surface, further comprising at least one dart in said front portion of said brief between said leg openings and at least one dart in said back panel to contour said front portion of said brief and said back panel to better retain said protective cup in a proper position to protect male genitals from adverse sports impact, said dart in said back panel also being configured to allow said back panel to conform to said concave back surface of said protective cup for enhanced athlete comfort.

3. The garment of claim 2 wherein said back panel of said pouch has one of said darts and said one dart extends centrally upward from said bottom point of said back panel.

4. The garment of claim 1 wherein said compression material comprises approximately 90% cotton and approximately 10% spandex.

5. The garment of claim 4 wherein said compression material further comprises threads having anti-microbial properties.

6. The garment of claim 1 wherein said fastening means comprises at least one hooking member and at least one cooperating pile member which when paired together form a hook-and-pile type of fastener.

7. The garment of claim 6 wherein said fastening means comprises at least one stretchable hook-and-pile type of fastener.

8. A protective sports garment configured according to standard sizes used in the garment industry for manufacturing underwear, for use in positioning a rigid protective cup in front of the front pelvic region of a male athlete to protect the genitals of the male athlete from adverse sports impact, said garment comprising a brief having an upper edge, a front portion, a waistband attached to said upper edge, and two leg openings laterally spaced apart from one another in positions opposed to said waistband; and wherein said garment also comprises said garment being made from compression material; a pouch being formed from a front panel and a back panel; said front panel and said back panel each having an upper portion which is substantially rectangular and has a length dimension, upper side edges, and a top edge; said front panel and said back panel also each having a lower triangular portion with lower sides which taper to a bottom point; said length dimension of said rectangular upper portion of said front panel being greater than said length dimension of said rectangular upper portion of said back panel; said length dimension of said rectangular upper portion of said front panel being sized to extend substantially from said waistband to said leg openings; said top edge and upper sides of said front panel being connected to said front portion of said brief, said upper sides of said back panel also being connected to said front portion of said brief, said lower sides and said bottom points of said front panel and said back panel having configurations substantially similar to one another and being connected to one another with stitching to form said pouch; said lower sides and said bottom points of said front panel and said back panel remaining separate from said brief so that gravity and material friction help maintain said pouch in its proper protective position but at the same time allow said pouch to have a limited range of motion to prevent impact directed to said pouch from tending to force from said pouch a protective cup placed therein; said pouch also comprising fastening means to securely attach said upper portion of said back panel to said front panel so that when a rigid protective cup is placed between said front panel and said back panel, said fastening means securely retains the protective cup therebetween in a proper position to protect the front pelvic region of a male athlete wearing said garment while engaging in sports activity.

9. The garment of claim 8 further comprising at least one dart in said front portion of said brief between said leg openings and at least one dart in said back panel to contour said front portion of said brief and said back panel for better positioning of a protective cup to protect male genitals from adverse sports impact, said dart in said back panel being configured to allow said back panel to conform to said concave back surface of said protective cup for enhanced athlete comfort.

10. The garment of claim 8 further comprising said back panel of said pouch having one of said darts and said one dart extending centrally upward from said bottom point.

11. The garment of claim 8 further comprising said compression material comprising approximately 90% cotton and approximately 10% spandex.

12. The garment of claim 8 further comprising said compression material having threads exhibiting anti-microbial properties.

13. The garment of claim 8 further comprising said fastening means comprising at least one hooking member and at least one cooperating pile member which when paired together form 4 hook-and-pile type of fastener.

14. The garment of claim 8 further comprising said fastening means comprising at least one stretchable hook-and-pile type of fastener.

15. A method for manufacturing a protective sports garment having a sports brief member and a pouch member that is partially detached from said sports brief member for use in positioning a rigid protective cup in front of the front pelvic region of a male athlete of a chosen size and stature to protect the genitals of said male athlete from adverse sports impact, wherein said method comprises the steps of providing material to make said sports brief to include the steps of providing a quantity of material sufficient to make a back portion for said brief, providing a quantity of material sufficient to make a front portion for said brief, providing a quantity of elastic material sufficient for encircling the waist of said male athlete, and providing a quantity of thread suitable for stitching said material;

providing material to make said pouch to include the steps of providing a quantity of material sufficient to make a front panel for said pouch, providing a quantity of material sufficient to make a back panel for said pouch that is shorter in length than said front panel, and providing at least one fastener;

forming said pouch from said front panel and said back panel through the steps of forming a dart centrally upward from a bottom point on said back panel, attaching a first part of said fastener centrally to one surface of said front panel, attaching a cooperating second part of said fastener centrally near to an upper edge of one surface of said back panel in a position to allow engagement of said second part of said fastener with said first part during use of said protective sports garment, forming a detached portion of said pouch by placing said front panel adjacent to said back panel adjacent to one another with said first and second parts of said fastener positioned away from one another; attaching a lower portion of said back panel to a lower portion of said front panel with said thread so that the contemplated protective cup will substantially fill said pouch when inserted therein; turning said detached portion inside-out so that said thread is positioned between said back panel and said front panel; and forming said sports brief through the steps of forming a dart centrally upward from a bottom edge of said front portion of said brief, attaching said bottom edge of said front portion of said brief centrally to a lower edge of said back portion of said brief to form a crotch seam, attaching said pouch to said sports brief by connecting side edges of said front panel and side edges of said back panel to said brief when sides edges of said front portion of said brief are attached to side edges of said back portion of said brief to form a waist opening and two leg openings in said sports brief, attaching an upper edge of said front panel of said pouch to said waistband at the same time an upper edge of said front portion of said brief and an upper edge of said back portion of said brief are attached to said waistband; and binding said leg openings to provide a smooth edge therearound for enhanced athlete comfort.

16. The method of claim 15 wherein the steps of providing a quantity of material sufficient to make the back portion of a brief for a male athlete of a chosen size and stature, providing a quantity of material sufficient to make the front portion of said brief, providing a front panel, and providing a back panel, all further comprise the providing of material and panels comprising approximately 90% cotton and approximately 10% spandex.

17. The method of claim 16 wherein the step of providing a quantity of material sufficient to make the back portion of a brief for a male athlete of a chosen size and stature, providing a quantity of material sufficient to make the front portion of said brief, providing a front panel, and providing a back panel, all further comprise the providing of material and panels having anti-microbial threads.

18. The method of claim 15 wherein the step of providing said fastening means further comprises the providing of at least one hook-and-pile type of fastener.

19. The method of claim 18 wherein the step of providing said fastening means further comprises the providing of at least one stretchable hook-and-pile type of fastener.

* * * * *